US006176283B1

(12) United States Patent
Knerr

(10) Patent No.: US 6,176,283 B1
(45) Date of Patent: Jan. 23, 2001

(54) ADJUSTABLE SUPPORT FOR CONVEYOR

(75) Inventor: Michael P. Knerr, Ridgefield, WA (US)

(73) Assignee: U.S. Natural Resources, Inc., Vancouver, WA (US)

( * ) Notice: Under 35 U.S.C. 154(b), the term of this patent shall be extended for 0 days.

(21) Appl. No.: 09/347,480

(22) Filed: Jul. 2, 1999

Related U.S. Application Data

(63) Continuation-in-part of application No. 09/098,920, filed on Jun. 17, 1998, now Pat. No. 5,918,653.

(51) Int. Cl.[7] ..... B27C 5/02

(52) U.S. Cl. ..... 144/248.4; 144/242.1; 144/248.5; 144/357; 144/382; 144/250.25; 144/250.2; 198/468.2; 198/502.2

(58) Field of Search ..... 83/371, 425.2, 83/435.2, 437, 730, 731; 144/3.1, 39, 41, 242.1, 246.1, 245.2, 248.4, 248.5, 250.24, 250.25, 356, 357, 376, 377, 382, 402, 404, 408, 416, 250.2; 198/434, 624, 502.2, 782, 468.2

(56) References Cited

U.S. PATENT DOCUMENTS

| | | | |
|---|---|---|---|
| 3,842,874 | 10/1974 | Noriyuki | 144/248.4 |
| 4,206,673 | 6/1980 | Detjen . | |
| 4,518,061 | 5/1985 | Wehmeyer . | |
| 4,741,413 | 5/1988 | Kishi . | |
| 4,846,237 | 7/1989 | Wolf . | |
| 4,881,584 | 11/1989 | Wislocker . | |
| 5,070,989 | 12/1991 | Brown . | |
| 5,232,030 | 8/1993 | Knerr . | |
| 5,382,772 | 1/1995 | Zumstein . | |
| 5,385,186 | 1/1995 | Head . | |
| 5,649,580 | 7/1997 | Mierau . | |
| 5,676,238 | 10/1997 | Saastamo . | |

*Primary Examiner*—W. Donald Bray
(74) *Attorney, Agent, or Firm*—Robert L. Harrington

(57) ABSTRACT

An adjustable support for a conveyor for controlling the position of a product such as a log. Support structure is provided near each end of the conveyor. The structure includes mechanism to shift the conveyor side ways and also has mechanism to elevate and lower the conveyor. Each structure is operable independent of the other.

4 Claims, 9 Drawing Sheets

ADJUSTABLE SUPPORT FOR CONVEYOR

This application is a Continuation-In-Part of U.S. patent application Ser. No. 09/098,920, now U.S. Pat. No. 5,918,653 filed Jun. 17, 1998 titled Adjustable Support for Conveyor, the disclosure of which is incorporated by reference.

FIELD OF THE INVENTION

This invention relates to an adjustable support, particularly for a conveyor, which enables the conveyor to be adjusted vertically and horizontally, and through a combination of adjustments as between a pair of supports, the conveyor can be adjusted for skew, taper and roll.

BACKGROUND OF THE INVENTION

There is an ongoing need to develop lumber handling systems for reducing logs into lumber whereby the maximum percentage of the available wood is utilized for lumber production. Logs are irregularly shaped and vary greatly in dimension, and the lumber produced therefrom is rectangular in cross section but has a wide range of cross section and lengthwise dimensions.

Consider that a log is tapered, curved and/or out of round. A scanner will establish the configuration and enter the data for computer evaluation. The computer determines the maximum boards of various dimensions that will fit that configuration as well as the cutting pattern for achieving that production. Then the log handling and/or log break down apparatus in response to the computer input follows the desired cutting pattern to produce the computed lumber pieces from that log.

There are numerous developments that have been made to the various components of the log handling and break down apparatus. The present invention applies to the infeed system, e.g., a conveyor or conveyors from which the logs are fed into the break down apparatus which may include, e.g, chippers and saws. Whereas conveyors have typically been adjustable only for elevation and side movement, the objective of the present invention is to provide adjustability for skew and tilt and preferably roll, as well as elevation and side movement.

BRIEF DESCRIPTION OF THE INVENTION

In the preferred embodiment of the present invention, the support assemblies for the conveyor bed include mechanism for independently raising and lowering the leading or trailing end of the conveyor bed and thus the log being conveyed and for independently side shifting the leading or trailing end of the conveyor.

In one embodiment of the invention disclosed in co-pending application Ser. No. 09/098,920, the complexity of adjustments is accomplished with two cylinders for each support. The two cylinders are anchored to a stationary base at opposed sides of the conveyor bed and extend angularly in a cross over relation to a movable conveyor support at opposite sides of the bed. Each cylinder is movable independently but cooperatively to side shift (in either direction), raise and lower that end of the conveyor bed. The pairs of cylinders (a pair for each support base) are cooperatively manipulated to achieve a variety of adjustments to the orientation of the conveyor bed.

Whereas the above embodiment of the invention is capable of performing all of the movements described, i.e., side and elevation movements as well as skew, tilt and roll, the cross over arrangement of the cylinders may not be as stable as other arrangements for controlling these movements. A number of embodiments are disclosed herein that have features that accordingly may be preferred over that of the arrangement whereby cylinders are crossed.

The conveyor is provided with a pivotal mounting as between the conveyor bed and the stationary bases in that the conveyor bed is not simply side shifted and elevated but is angularly shifted relative to the bases.

Movements of the supports can be made as a single adjustment to align a log relative to subsequent apparatus or the movements may be ongoing. Consider that a log being conveyed is slightly curved. The log may be oriented by the conveyor to feed the log's leading end into a saw. As the log feeds through the saw, the conveyor position can be continuously adjusted to accommodate the curve of the log. (This movement is referred to as side slewing). A similar ongoing adjustment can be made for feeding a truncated log past a chipper, i.e., the front end of the conveyor can be raised or lowered to tilt the log as the log is fed through the chipper (tilt slewing).

A further use of the preferred multiple adjustment feature would be the raising of both right side or both left side support positions. This angularly adjusts a log on the conveyor to provide log roll positioning.

All of the above as well as numerous additional benefits will be appreciated by those skilled in the art upon reference to the detailed description and the drawings referred to therein.

DESCRIPTION OF THE PREFERRED EMBODIMENT

Wood products, such as logs or cants hereafter collectively referred to as a log L, that are to be processed into lumber pieces are controllably oriented and positioned to maximize production of lumber from the log L.

Figure 1:
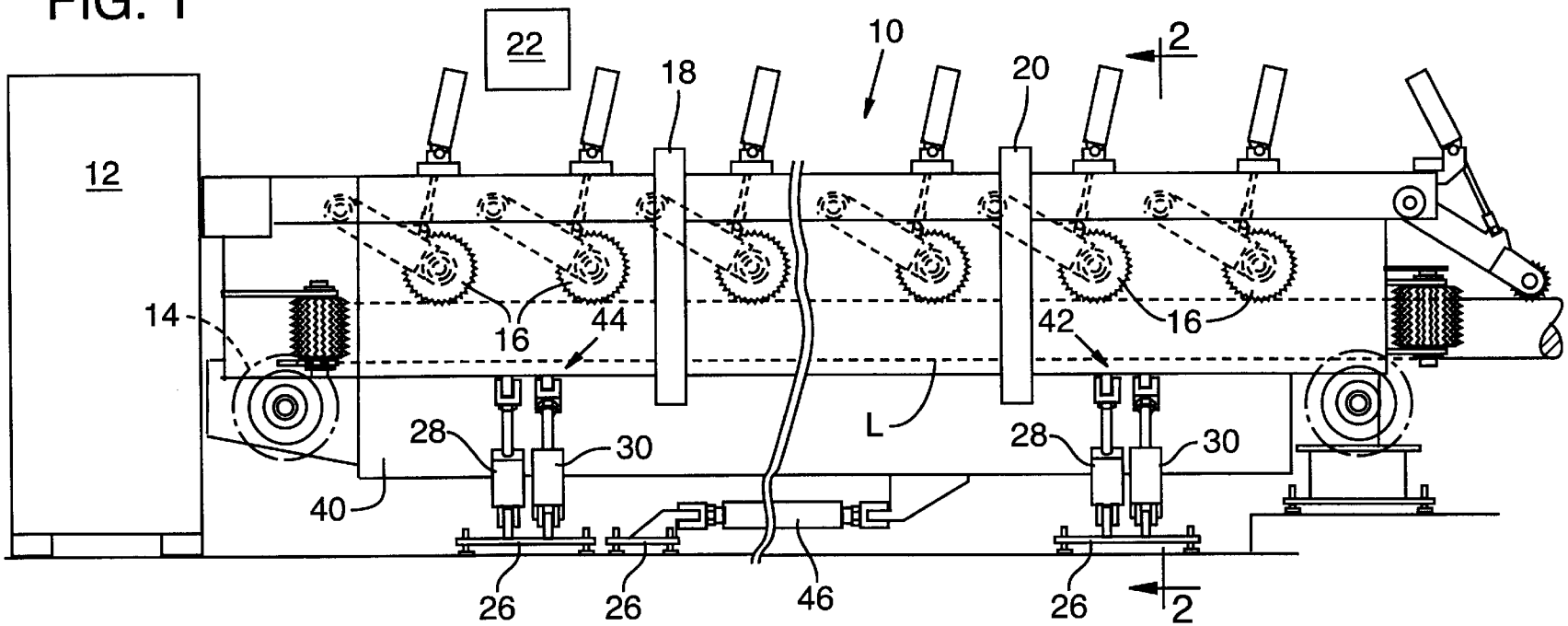
FIG. 1 is a side view of an infeed conveyor system incorporating the adjustable support of the present invention.
Figure 2:
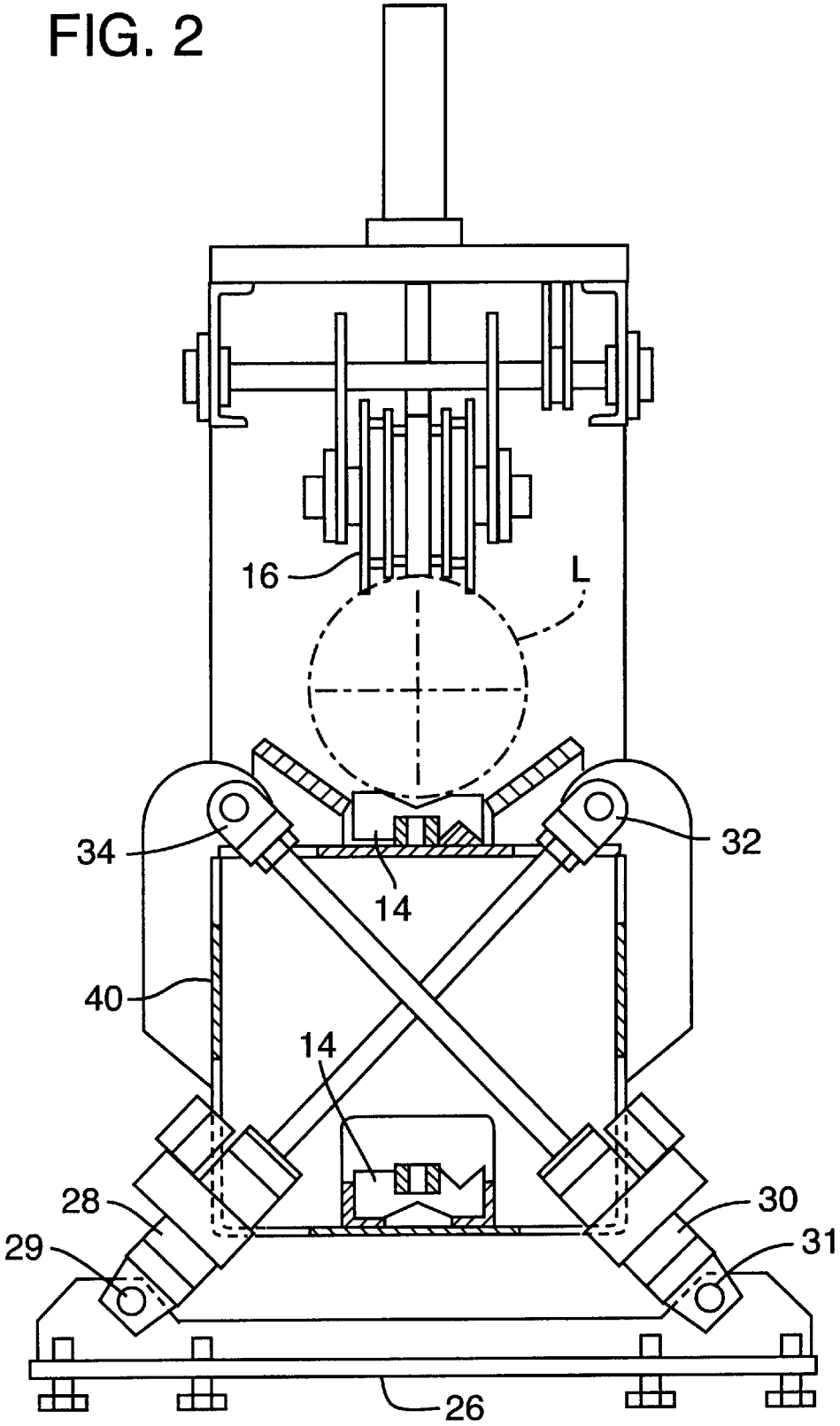
FIG. 2 is an end view of the infeed system as viewed on view lines 2—2 of FIG. 1.
Figure 3A:
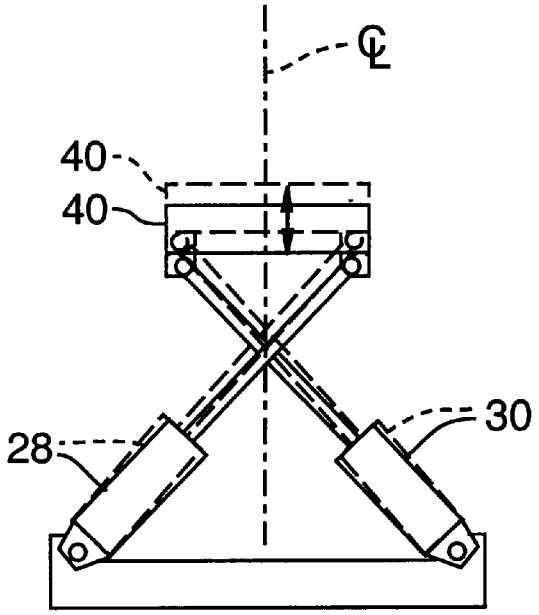
FIGS. 3A and 3B are views in diagram form showing examples of positional movement of the conveyor bed of the infeed system of FIG. 1.
Figure 3B:
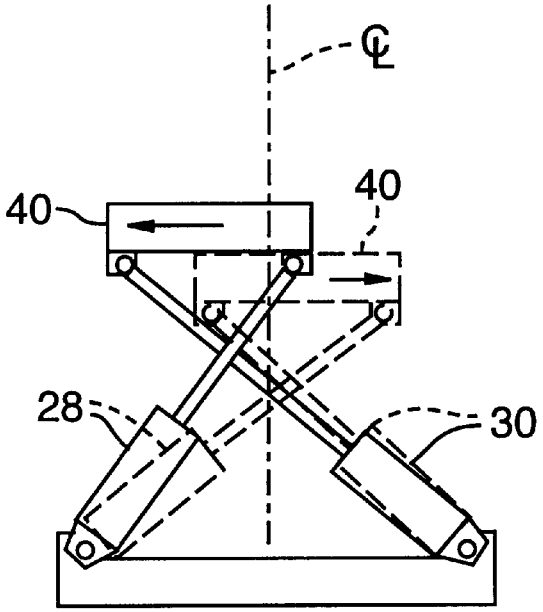

There are varied conveyor systems or assemblies that are utilized to convey an oriented log L into subsequent processing equipment. FIG. 1 illustrates one type of a conveyor system 10. The conveyor system 10 includes a log turner 12 that will rotate the log L into the desired rotative orientation such as in a horns down position. Log turners are well known in the industry and, therefore, log turner 12 is not detailed. In this embodiment, the conveyor system has a flighted chain 14 in combination with overhead rollers 16 to effectively hold and transport the oriented log L on the conveyor system 10. The rollers 16 are pivotally movable upwardly and downwardly toward the flighted chain 14 to accommodate different sizes of logs. The rollers 16 and the flighted chain 14 will hold the log L captive in its oriented position as it is being transported on the conveyor system 10. The log L as it is being transported by the conveyor system 10 is scanned by scanners 18 and 20. The scan data from the scanners 18 and 20 is input to a computer 22. The computer 22 will analyze the scan data and compute a desirable array of lumber pieces that can be generated from the log L. The computer further determines the need to adjust the log position relative to the processing equipment, e.g., saws and chippers, to obtain the desired breakdown of the log L.

The computer may determine, for example, that the log needs to be elevated or lowered relative to the processing equipment and/or the log may require shifting laterally to one side or the other. The adjustable support of the conveyor system of the present invention is arranged to accordingly adjust the position of the log L being conveyed on the conveyor system 10.

FIGS. 1, 2, 3A and 3B illustrate the conveyor system 10 that incorporates one example of the adjustable support of the present invention. This is described in the parent patent application Ser. No. 09/098,920.

Figure 4:
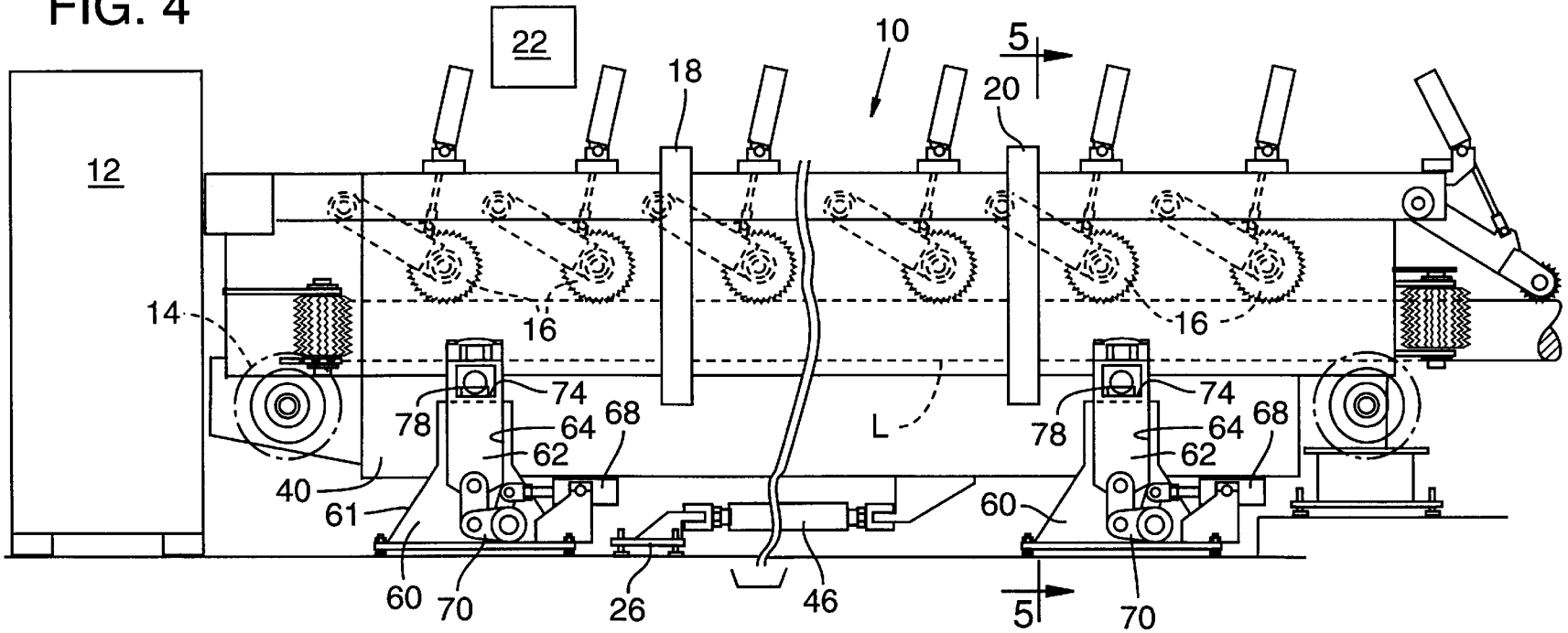
FIGS. 4 and 5 illustrate another embodiment of an adjustable support for the infeed system.
Figure 5:
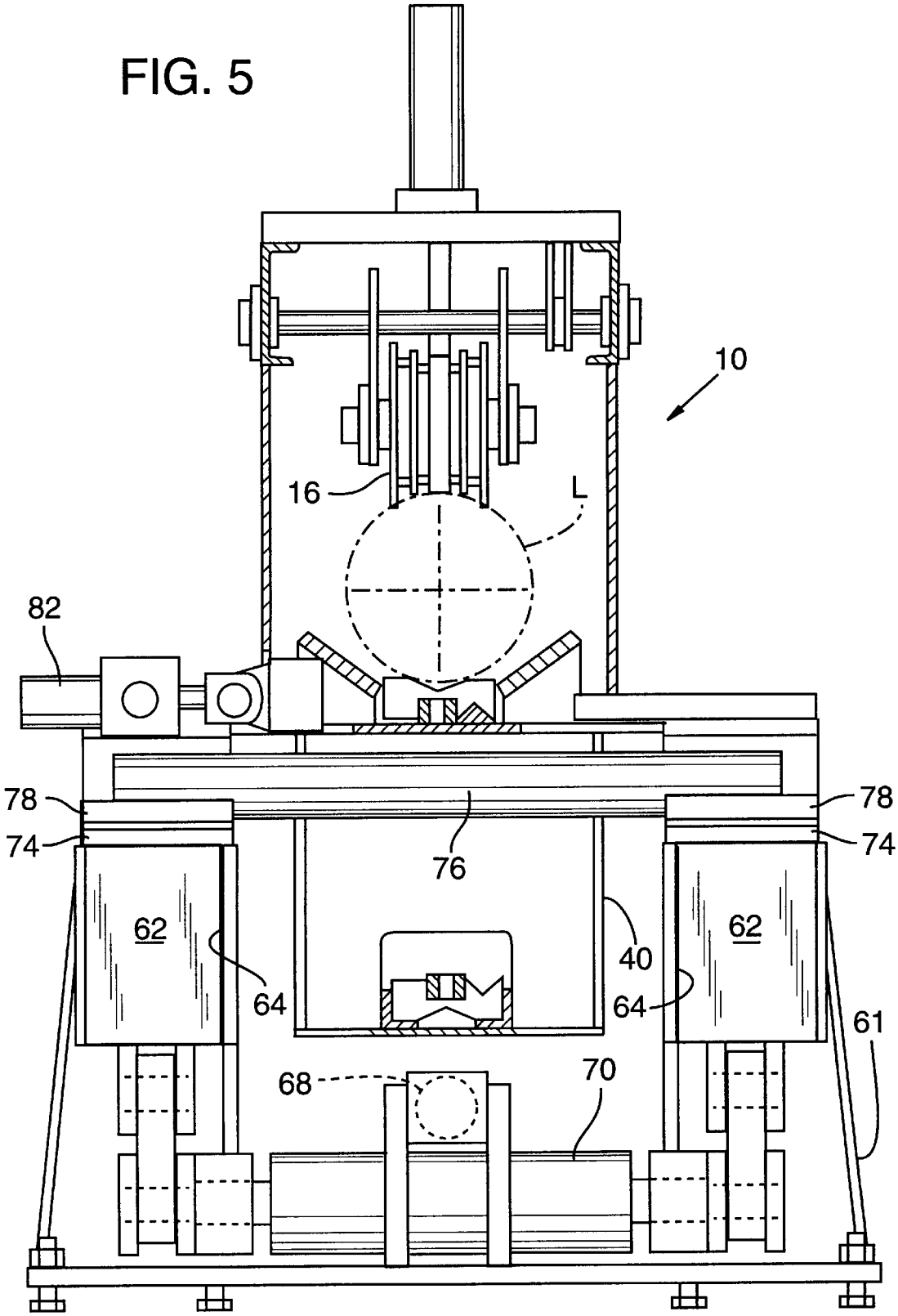

FIGS. 4 and 5 illustrate another example of an adjustable support for the conveyor system or assembly 10. Pedestal assemblies 60 support the conveyor bed or frame 40 and as will be explained, have mechanism to provide elevation in the vertical direction and side shifting of the conveyor bed transverse to the flow path of the conveyor. The pedestals 60 have support carriages 62 that are movable upwardly and downwardly on the pedestal base 61. The support carriages 62 are guided on the pedestal base 61 by guide ways 64. A cylinder 68 is provided to elevate and lower the support carriages 62 on the pedestal base 61. The cylinder 68 is coupled to a toggle arm assembly 70 which in turn is coupled to the support carriage 62. When the cylinder 68 is retracted, it will pivot the toggle arm assembly 70 to elevate the carriage 62 relative to the pedestal base 61 and when the cylinder 68 is extended, it will pivot the toggle arm assembly in the opposite direction to lower the carriage 62 relative to the pedestal base 61. Each carriage 62 has a flat support pad 74 that supports the conveyor bed 40. A shaft 76 fixedly attached to the conveyor frame or bed 40 extends outwardly from the frame 40 and is affixed at each end to a support pad 78. The pads 78 of the conveyor bed 40 are mated to the pads 74 of the support carriages 62. The pads 74 and 78 have a low co-efficient of friction and the conveyor bed 40 is thus slidably movable relative to the carriages 62. A side shift cylinder 82 is fixedly mounted to one of the carriages 62 and has its cylinder rod end coupled to the frame or bed 40. Extension of the cylinder 82 will side shift the frame or bed 40 relative to the pedestal base 61 with the pad 78 of the conveyor bed 40 sliding on the support pad 74 of the carriage 62. The retraction of the cylinder 82 will side shift the conveyor in the opposite direction. A tie rod 46 (FIG. 4) is coupled to the frame 40 and a bracket 26 to prevent longitudinal movement of the frame 40.

Figure 6:
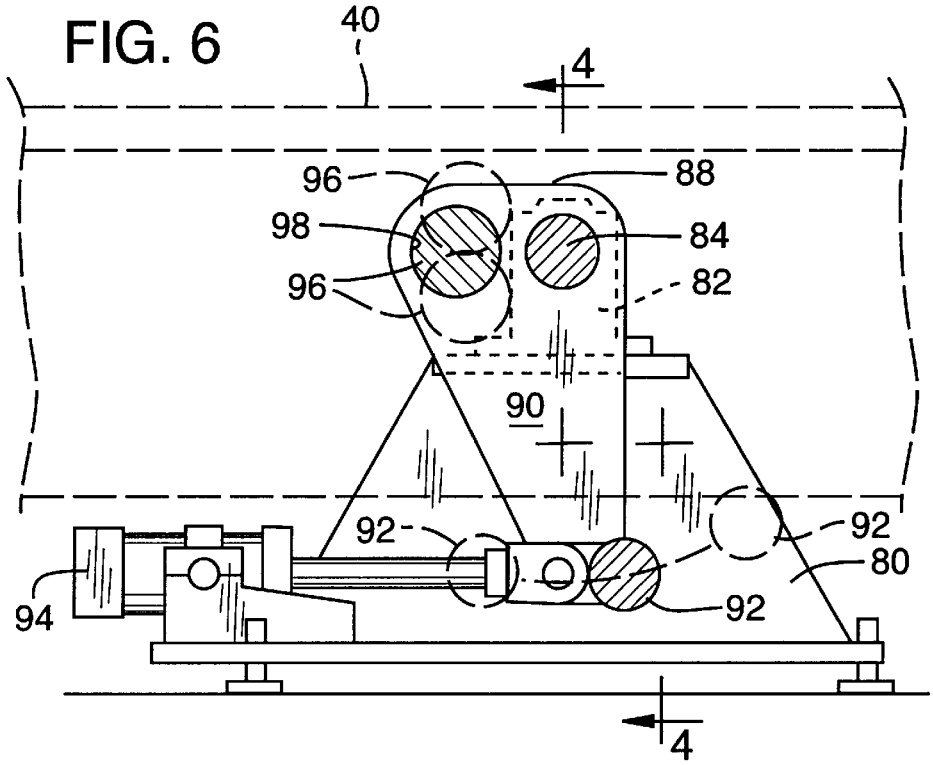
FIGS. 6 and 7 illustrate another embodiment of an adjustable support for the infeed system.
Figure 7:
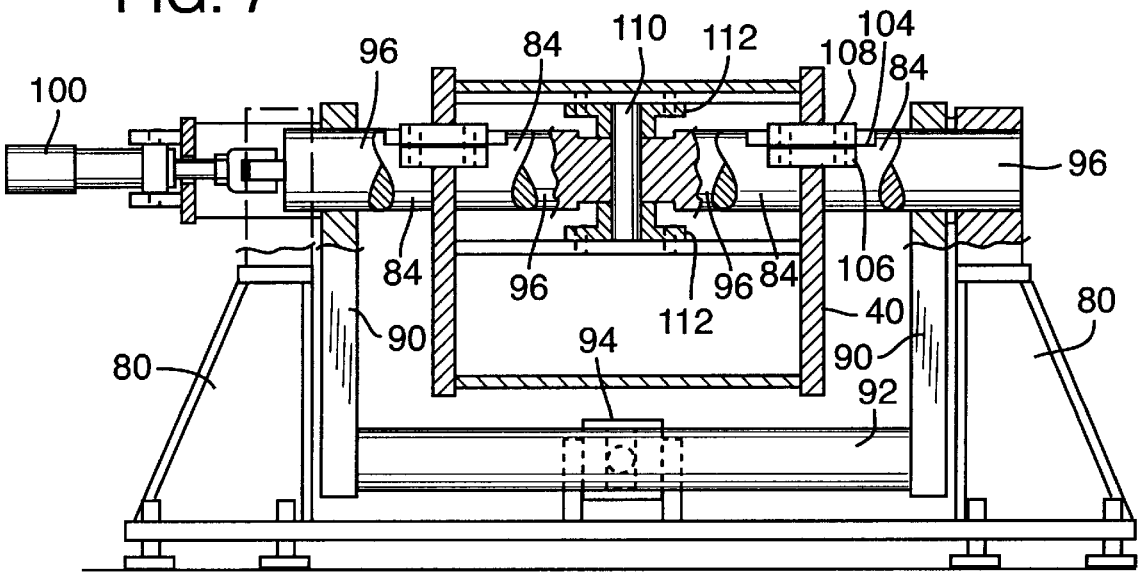
Figure 8:
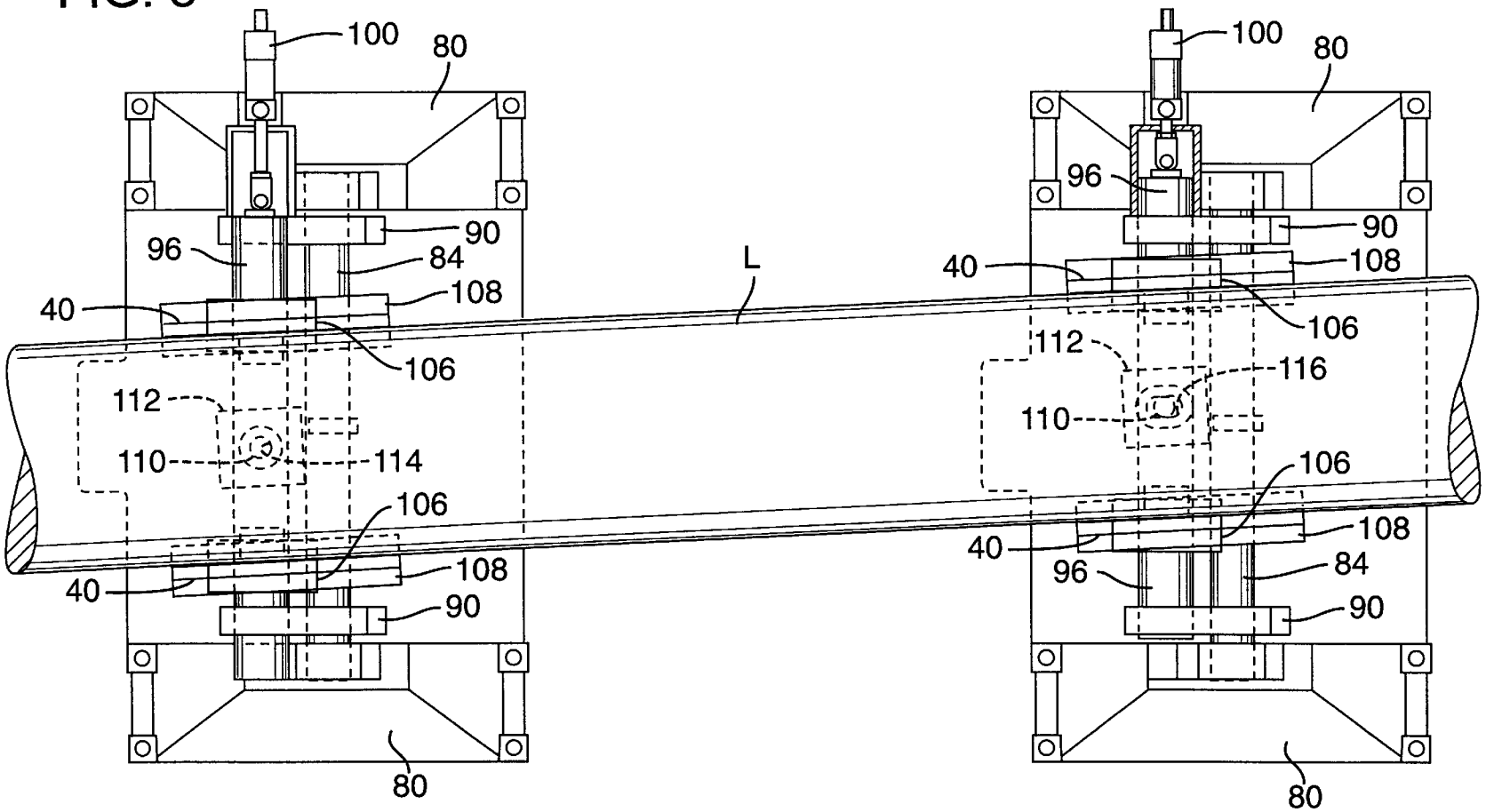
FIG. 8 illustrates the infeed system being skewed by side shifting the adjustable supports of FIGS. 6 and 7.

FIGS. 6, 7 and 8 illustrate another example of an adjustable support for the conveyor 10. The adjustable support of FIG. 6 has pedestal bases 80 on which an adjustable support carriage is mounted. Bearing blocks 82 are mounted on each of the pedestal bases 80 and support a pivot shaft 84. The pivot shaft 84 is rotatable in the bearing blocks 82 but are not slidably adjustable in the blocks.

A lift frame 88 is fixedly mounted on the pivot shaft 84. The lift frame 88 has legs 90 that are mounted on the pivot shaft 84 with the legs 90 being joined by a cross member 92. The cross member 92 is coupled to a lift cylinder 94 which is arranged to pivot the lift frame 88 on the pivot shaft 84. A slide shaft 96 is mounted in bores 98 of the legs 90 of the lift frame 88. The slide shaft 96 is slidably movable in the bores 98. The slide shaft 96 has two flat portions 104 on which slide pads 106 are mounted. The frame or bed 40 of the conveyor has pads 108 in engagement with the pads 106 mounted to the slide shaft 96. The slide shafts 96 support the conveyor bed 40. Retraction of the cylinder 94 pivots the lift frame 88 which moves the slide shaft 96 upward to elevate the conveyor bed 40. Extension of the cylinder 94 pivots the lift frame 88 in the opposite direction to lower the conveyor bed 40. An opening is provided in the sides of the frame 40 to provide clearance for the shaft 88 as the conveyor bed is either elevated or lowered.

A side shift cylinder 100, which is mounted to the lift frame 88, is coupled to the slide shaft 96 and is arranged to slidably move the slide shaft 96 in the bores 98 of the legs 90. A pivot pin 110 extends through the slide shaft 96 and engages pin brackets 112 on the frame 40 of the conveyor. One of the slide shafts 96 and one of the pin brackets 112 has a circular bore 114 to receive the pin 110 and the other slide shaft 96 and other bracket 112 has an elongate slot 116 to receive the pin 110 (FIGS. 7 and 8). This arrangement does not require a tie rod to prevent longitudinal movement. The pin 110 fitting in the bore 114 prevents longitudinal movement.

Figure 9:
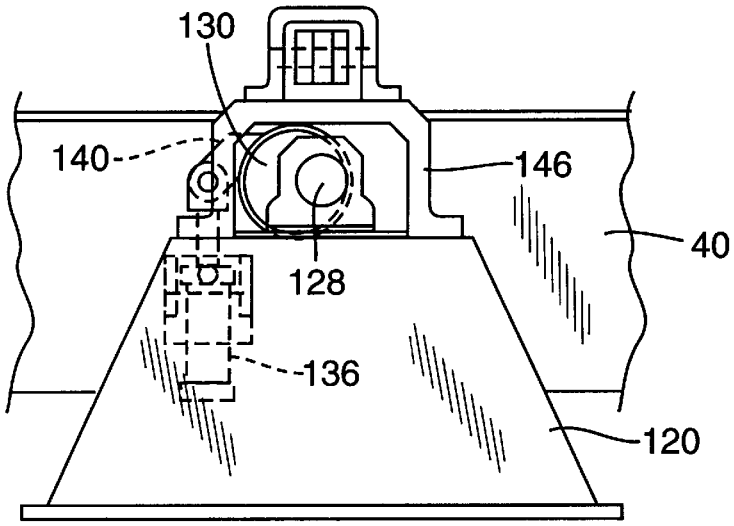
FIGS. 9, 10 and 11, illustrate another embodiment of an adjustable support for the infeed system.
Figure 10:
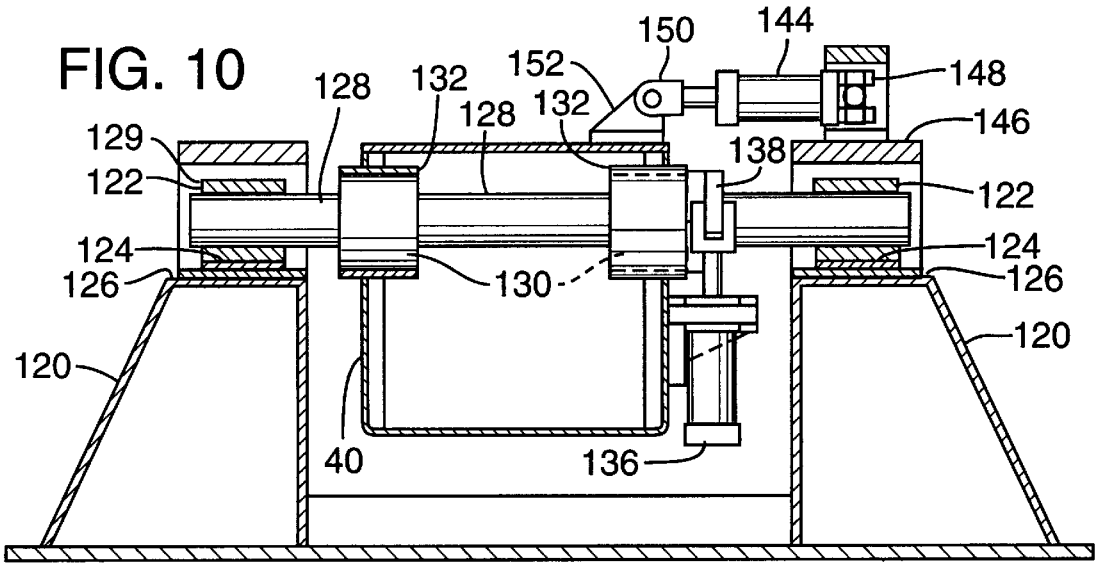
Figure 11:
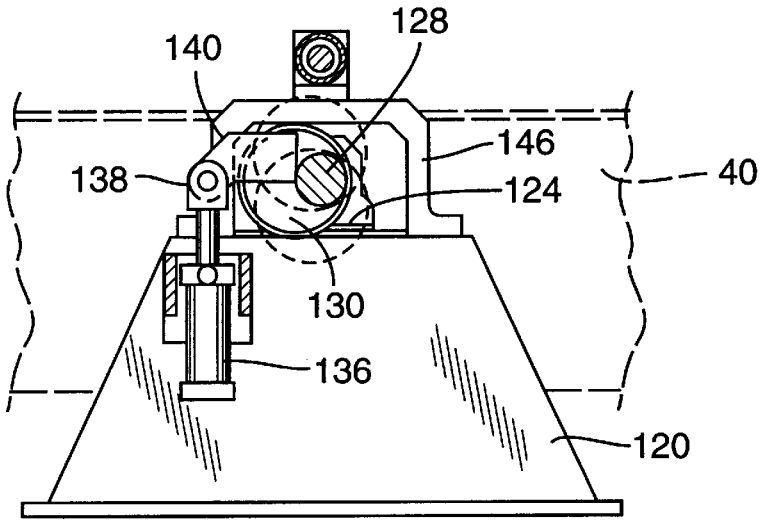

FIGS. 9, 10 and 11 illustrate another embodiment of an adjustable support for the conveyor assembly or system. Pedestal bases 120 are provided as the basic support structure. The pedestal bases 120 have a top pad 126 on which bearing blocks 122 are mounted. The blocks 122 have pads 124 in contact with the top pads 126 of the pedestal bases 120. The blocks 122 are accordingly slidably moveable on the pedestal bases 120. A shaft 128 is rotatably mounted in the blocks 122 and not axially moveable.

Eccentric lobes 130 are fixedly mounted to the shaft 128 with the lobes 130 being fitted in sleeves 132 provided in the frame 40 of the conveyor. A lift cylinder 136 is mounted to the frame 40 of the conveyor 10 and has a cylinder end 138 on a bracket 140 that is coupled to the shaft 128 and thus the lobes 130. Extension and retraction of the cylinder 136 thus will pivot the shaft 128 in the bearing blocks 122 and the lobes 130 in the sleeves 132. When the cylinder 136 is extended, the shaft 128 and the lobes 130 will be rotated about the axis of the shaft 128 and the lobes 130 will cause the frame 40 of the conveyor to elevate. Similarly when the cylinder 136 is retracted, the shaft 128 and the lobes 130 will be rotated so that the frame 40 of the conveyor 10 will be lowered.

A side shift cylinder 144 is mounted to a support bracket 146 that is affixed to the pedestal bases 120. The cylinder 144 has a four-way universal type mount 148 to permit the cylinder 144 to pivot in all directions. The cylinder end 150 of the cylinder 144 is coupled to a bracket 152 mounted to the frame or bed 40 of the conveyor 10. Extension and retraction of the cylinder 144 will cause the frame 40 to move sideways relative to the flow path of the material on the conveyor 10. The conveyor bed 40 is slidably movable sideways by the movement of the bearing blocks 122 on the pads 126 of the pedestal 120. The conveyor is prevented from moving longitudinally by the tie rod 46 as illustrated in FIG. 4.

FIG. 8 illustrates by example the conveyor (of FIGS. 6 and 7) side shifted (skewed) by moving one of the slide shafts 96 in one direction and by moving the other slide shaft 96 in the opposite direction. The frame 40 as it is side shifted pivots on the pins 110. The pivoting causes the frame 40 to move on the pads 106 on the slide shaft 96.

The adjustable support of the present invention provides the capability of side shifting the conveyor at either or both of the supporting structures and the side shifting may be in the same or opposite directions. Similarly each end of the conveyor may be elevated or lowered independent of the other end. The computer from the scan data controls the elevation and skew of the log L on the conveyor 10. It will be appreciated that the computer will control both the skew and elevation based on the scan data and will perform the required movements as the log is being conveyed.

Figure 14:
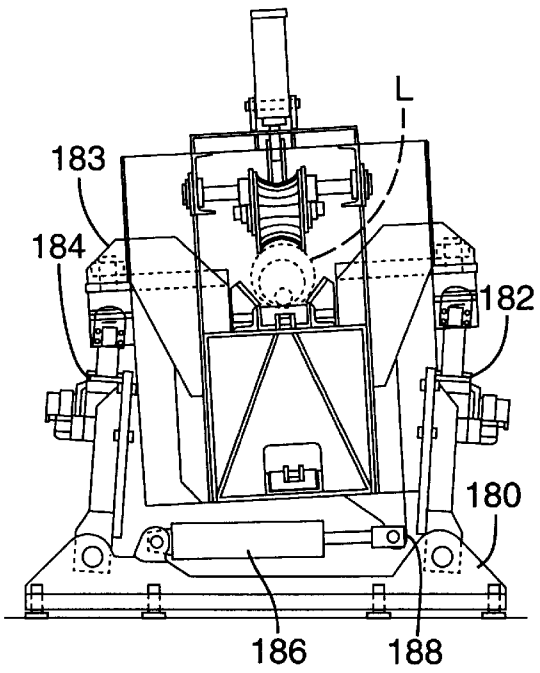
FIGS. 12, 13 and 14 illustrate another embodiment of an adjustable support for the infeed system.
Figure 13:
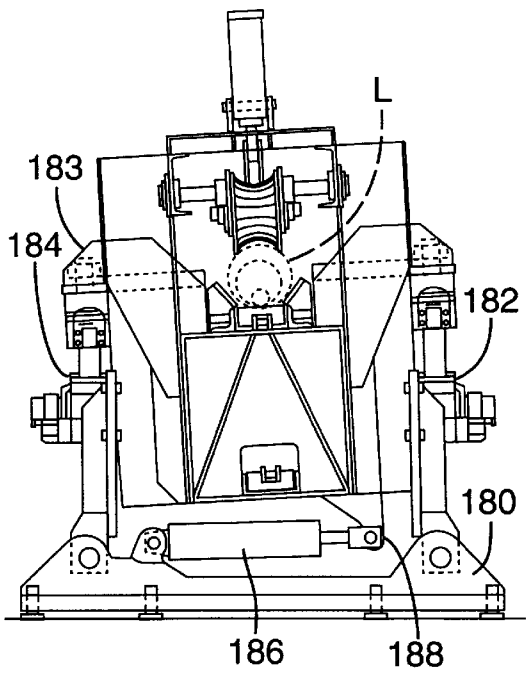
Figure 12:
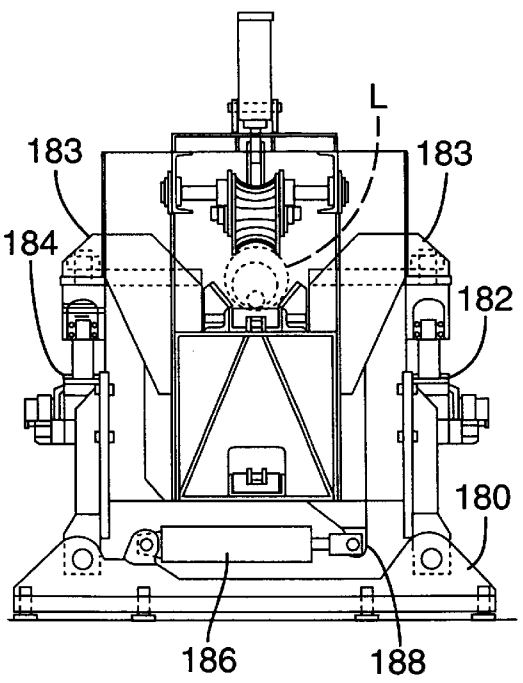

FIGS. 12, 13 and 14 illustrate another example of an adjustable support for the conveyor system or assembly 10 that was briefly described in the parent application. Base units 180 are provided for the adjustable support and are positioned near each end of the frame 40 of the conveyor assembly. A tie rod 46 (such as illustrated in FIG. 4) is provided to prevent longitudinal movement of the conveyor assembly. One end of lift cylinders 182 and 184 have one end pivotally mounted to the base unit 180. The opposite end of the cylinders 182 and 184 are pivotally coupled to brackets 183 extending from the frame 40 of the conveyor assembly. Uniform extension and retraction of the cylinders 182, 184 will elevate and lower the frame 40.

A cylinder 186 has one end pivotally mounted to the base 180 and its other end pivotally mounted to a bracket 188 extending from the frame 40.

The arrangement of the adjustable support of FIGS. 12, 13 and 14 provides controlled movement of the frame 40 of the conveyor assembly. As previously mentioned uniform extension of the cylinders 182, 184 will elevate the frame 40 without side shifting or rotation of the frame 40. The cylinders 182, 184 on one base may be extended independent or to a different degree than the cylinders 182, 184 on the other base. The frame 40 may thus be tilted from end to end by elevating one end to a different height than the other end. Similarly the cylinders 182, 184 on one base may be retracted to a different degree than the cylinders 182, 184 on the other base.

Extension or retraction of the cylinder 186 on one base 180 independent of the cylinders 182, 184 will side shift the frame 40 relative to that base 180. The cylinder 186 on the other base may be extended or retracted in the same direction as the first cylinder 186 to shift the frame 40 in the same direction. Extension or retraction of the cylinder 186 on the other base may be extended or retracted in a direction opposite that of the first cylinder 186 so that the frame 40 is side shifted in one direction relative to one base and is side shifted in the opposite direction relative to the other base.

Coordinated movement of the cylinders 182, 184 and 186 on the bases 180 provides the capability of rotating, side shifting, elevating and/or lowering the frame 40 of the conveyor assembly. As shown in FIG. 13, for example, the cylinder 184 has been retracted, the side shift cylinder 186 has been extended and the cylinder 182 has been extended. The cylinders 182 and 184 are extended and retracted sufficiently such that they remain in the vertical plane when the side shift cylinder 186 is extended. This coordinated movement of the cylinders causes the frame 40 to tilt side to side (rotate) and log L received on the conveyor to be rotated a few degrees.

FIG. 14 illustrates another example of the coordinated movement of the cylinders 182, 184 and 186. In this example the cylinder 184 is retracted, the cylinder 182 is extended and the cylinder 186 is extended. This coordinated movement side shifts the conveyor frame 40 as well as tilting the frame 40 which rotates the log L.

While only a few examples have been illustrated, it will be appreciated that the frame 40 may be moved in unlimited variations by the coordinated movement of the cylinders and/or independent movement of the cylinders.

Those skilled in the art will recognize that modifications and variations may be made without departing from the true spirit and scope of the invention. For example, one variation would have a cylinder at each side of the conveyor support and a third horizontal cylinder at each support for stabilizing and side positioning as differentiated from the crossed cylinders described above. The invention is therefore not to be limited to the embodiments described and illustrated but is to be determined from the appended claims.

The invention claimed is:

1. A conveyor assembly comprising:

a front conveyor support mounted on a front support base and a rear conveyor support mounted on a rear support base, and an elongated conveyor bed extended between and supported on said conveyor supports;

said conveyor supports as mounted on the support bases and the conveyor bed as supported on the conveyor supports cooperatively structured to provide lateral, vertical and pivotal movement of the conveyor bed relative to the support bases for selective orientation of said conveyor bed up and down, side to side, skew and tilt;

a first set of at least first and second motors between the front conveyor support and front support base providing vertical movement and lateral movement as between the front conveyor support and front support base, and a second set of at least first and second motors between the rear conveyor support and rear support base providing vertical movement and lateral movement as between the rear conveyor support and rear support base; and a control for independent control of the first and second sets of motors and as between the first and second motors of each set of motors for independent lateral and vertical movement of the conveyor supports relative to the conveyor bases.

2. A conveyor assembly as defined in claim 1 wherein a computer provides the control that determines the desired orientation of the conveyor bed and controls the motors for achieving that orientation.

3. A conveyor assembly as defined in claim 2 wherein the movements of the motors are ongoing during a process of conveying to achieve slewing of the conveyor bed.

4. A conveyor assembly as defined in claim 2 wherein each support defines a left side and a right side, said sets of motors include at least three motors including a lateral moving motor and left and right vertical moving motors arranged to elevate one of said left and right sides relative to the other of said left and right sides to adjust the conveyor bed's roll angle.

* * * * *